US006352151B1

(12) United States Patent
Stewart

(10) Patent No.: US 6,352,151 B1
(45) Date of Patent: Mar. 5, 2002

(54) JEWELRY BOX HAVING ATTACHED SEGMENTED LID MEMBER

(75) Inventor: Glenn Stewart, Dallas, TX (US)

(73) Assignee: Spirit International, Inc., Farmers Branch, TX (US)

( * ) Notice: Subject to any disclaimer, the term of this patent is extended or adjusted under 35 U.S.C. 154(b) by 0 days.

(21) Appl. No.: 09/546,980

(22) Filed: Apr. 11, 2000

(51) Int. Cl.[7] ..... B65D 51/00; A45C 11/04

(52) U.S. Cl. ..... 206/45.29; 206/6.1; 206/566; 206/768

(58) Field of Search ..... 206/6.1, 566, 45.28, 206/45.29, 45.3, 751, 752, 767, 768

(56) References Cited

U.S. PATENT DOCUMENTS

| | | | | |
|---|---|---|---|---|
| 2,024,702 A | * | 12/1935 | Powell | 206/45.29 |
| 2,304,758 A | * | 12/1942 | Bothan | 206/752 X |
| 2,380,052 A | * | 7/1945 | Koller et al. | 206/566 X |
| 2,788,123 A | * | 4/1957 | Levis et al. | 206/566 X |
| 3,930,576 A | | 1/1976 | Stephens et al. | |
| 4,043,450 A | | 8/1977 | Rielly | |
| 4,120,394 A | | 10/1978 | Soltes | |
| D275,530 S | | 9/1984 | Duckworth | |
| 4,919,259 A | | 4/1990 | Beaulieu | |
| 5,069,332 A | | 12/1991 | Williams et al. | |
| 5,383,552 A | | 1/1995 | Dikowitz | |
| 5,547,072 A | | 8/1996 | Kaiser | |
| 5,579,906 A | | 12/1996 | Fabbri et al. | |
| D385,781 S | | 11/1997 | Levine et al. | |
| D395,755 S | | 7/1998 | Hulin | |
| 5,810,162 A | | 9/1998 | Au et al. | |

* cited by examiner

*Primary Examiner*—Bryon P. Gehman
(74) *Attorney, Agent, or Firm*—Haynes and Boone, LLP

(57) ABSTRACT

A jewelry box having a segmented lid structure and a tray structure collectively defined by bottom, front, first side, rear and second side walls. An insert for supportably mounting an article of jewelry is received within an interior space of the tray structure. The segmented lid structure is pivotable between first and second positions and includes first, second, third, fourth and fifth parts. Inner side surfaces of the first and second parts of are fixedly secured to outer side surfaces of the bottom and rear walls, respectively. In the first position, an inner side surface of the third part engages the first side, rear and second side walls of the tray structure to cover a first portion of the interior area of the tray structure, the inner side surface of the third part engages the first and second side walls of the tray structure to cover a second portion of the interior area of the tray structure, and the fifth part is insertably received in a slot between the insert and the inner side surface of the front wall to secure the segmented lid structure in position. In the second position, the outer side surface of the third part engages the outer side surface of the second part and the outer side surfaces of the fourth and fifth parts engage the outer side surface of the first part. In this position, the segmented lid structure no longer blocks access to the interior area of the tray structure. A sheath is attached to the inner side surface of the third part and characters are imprinted on the inner side surface of the fifth part and the outer side surface of the fourth part.

19 Claims, 4 Drawing Sheets

JEWELRY BOX HAVING ATTACHED SEGMENTED LID MEMBER

TECHNICAL FIELD

The invention relates to jewelry boxes and, more particularly, to a jewelry box having an attached segmented lid member which is both easily hidden from view and suitable for use as part of a display.

BACKGROUND OF THE INVENTION

Jewelry has long been a traditional gift, particularly within the family or between those, while not members of the immediate family, who share a significant personal relationship. For example, wedding and engagement rings are oftentimes highly prized family possessions. Typically, an item of jewelry includes one or more jewels, for example, diamonds, sapphires, emeralds or the like, mounted in a setting formed of a precious metal such as gold or silver. Depending on the type, size and quality of the jewels used, the cost of a jewelry item may range from hundreds to thousands of dollars.

Simply put, the jewelry box is a container used to hold an article of jewelry which typically includes a precious gemstone. When purchased, the precious gemstone-type article of jewelry is placed in a jewelry box for storage, transport and, if purchased as a gift, presentation to the ultimate recipient. The most common jewelry box includes a body member having a slot or other aperture for receiving the precious gemstone-type article of jewelry and a lid member, pivotably hinged to the body member and movable between a closed position in which the precious gemstone-type article of jewelry is protectively covered by the lid member and an open position in which the precious gemstone-type article of jewelry is readily accessible. In the open position, the lid member is typically generally orthogonal to the body member and cannot be pivoted further without damaging the hinge mounting the lid member to the hinge member. One such jewelry box may be seen by reference to U.S. Pat. No. 3,930,576 to Stephens.

Like many other jewelry box designers, Stephens further contemplates that the disclosed jewelry box may also be used for displaying a diamond ring or other item of jewelry. When used for display purposes, the jewelry box disclosed in Sanders would be placed on a counter, shelf or other display structure with the lid member pivoted into the open position to reveal the diamond ring or other item of jewelry. Other hinged boxes used to display jewelry or other items are disclosed in U.S. Pat. Nos. 4,043,450 to Rielly, 5,547,072 to Kaiser and Des. 385,781 to Levine et al.

Of the various gemstones used in precious gemstone-type articles of jewelry, the most popular is the diamond. Diamonds are measured in carats. While diamonds having a wide variety of carat weights are commercially available, diamonds which weigh a full carat or a simple fraction thereof, typically, ¼, ½ or ¾ carat tend to be more popular with consumers. For example, an "irregular" weight diamond, for example, a 0.60 carat diamond, is often harder to sell than a "regular" weight diamond, for example, a ½ carat diamond of equal quality. In an attempt to increase the popularity of irregular weight diamonds, many such diamonds now come with a "Certificate of Authenticity" issued by a gemological institute, such as the International Gemological Institute (or "IGI") or the Gemological Institute of America (or "GIA"). The Certificate of Authenticity often includes a description of the diamond ring or other jewelry item which includes one or more of the diamond's carat weight, estimated retail replacement value and a photograph of the diamond ring or other jewelry item itself. While receiving such a certificate with each diamond ring or other jewelry item purchased has considerable appeal to consumers, some complications have arisen in this practice.

One such complication relates to how the certificate should be provided to the purchaser. The various authenticating institutions have standardized the certificates to have a length of approximately 3⅜ inches and a height of approximately 2⅛ inches. The certificates are formed of a flexible plastic material that resists folding. While the dimensions of jewelry boxes have never been standardized, a common set of dimensions for a jewelry box designed to hold a diamond ring are approximately 2⅛ inches by 1⅞ inches. Since the certificate is larger than a typical jewelry box and cannot be folded, most certificates are provided to the consumer in a separate envelope. However, diamond rings and other jewelry items may spend several months "on-the-shelf" with hundreds of other jewelry items before being sold. Maintaining the certificate for each of the jewelry items in a common file quickly becomes a time-intensive task. If, however, considerable time is not spent to keep the certificates in order, locating a specific certificate could take hours. Further complicating the task is that, unlike most other consumer goods, jewelry items are rarely marked with the name of the manufacture or a model or serial number. Thus, designing a filing system for the jewelry items which will enable any specified certificate to be readily located remains a difficult task.

The easiest solution has been to place the envelope containing the certificate describing a jewelry item under the jewelry box which holds the jewelry item being displayed. However, this solution has its own drawbacks. While the retailer can easily locate the certificate related to a specific item of jewelry, the certificate may easily be lost or otherwise disassociated from the diamond ring or other item of jewelry, particularly after a number of years have elapsed since the retail store initially took possession of the certificate. Furthermore, while being displayed, the placement of an envelope under the jewelry box for each item of jewelry offered for sale detracts tremendously from the otherwise elegant display case that typically holds such items when offered for sale.

Another solution has been to enlarge the jewelry box such that the certificate may be mounted in a lid member thereof. Rather than being hinged to the body member, for such jewelry boxes, the lid member is attached to the body member by a pair of arms, each of which is fixedly secured, on opposite ends thereof, to the body and lid members, respectively. To enhance the display of a diamond ring or other item of jewelry placed in the jewelry box, the arms are rotatable on both ends, thereby enabling the lid member to be opened and then pivoted underneath the body member into a display position. However, a drawback to such jewelry boxes is that the lid member tends to raise the body member an inch or so above the display surface, a feature that again tends to distract from the item of jewelry being displayed in the jewelry box. Thus, while functional, these rather cumbersome jewelry boxes are particularly inelegant. Furthermore, the certificate is not visible to the retail customer and, as a result, does not serve its intended function, that of contributing to the sale of the associated merchandise.

Finally, while not directed to jewelry boxes for simultaneously storing and/or displaying diamond rings or other items of jewelry and carrying a certificate of authenticity, the art has disclosed a variety of display cases having a lid member mounted to a body member thereof. U.S. Pat. No. 4,919,259 to Beaulieu discloses a portable display case formed in three sections and including hinging strips interconnecting the respective sections. Similar teachings may be found by reference to U.S. Pat. Nos. 4,120,394 to Soltes and 5,069,332 to Williams et al. In U.S. Pat. Nos. Des. 275,530 and Des. 395,755, the respective interconnecting strips appear to sit across a rear side wall of the body member when the jewelry container and cosmetic case, respectively, are closed.

SUMMARY OF THE INVENTION

It is, therefore, the object of this invention to provide a jewelry box configured to carry a certificate of authenticity while enhancing the display of an item of jewelry carried thereby by enabling an attached segmented lid member thereof to selectively be hidden from view or incorporated into the display of the jewelry item, thus enabling the certificate of authenticity to form an integral element of a sales presentation when desired.

In one embodiment, the present invention is directed to a jewelry box which includes a body member and a segmented lid member. The body member includes walls which collectively define an aperture for accessing an interior space thereof. The segmented lid member, on the other hand, includes a first part fixedly attached to the body member and a second part hingedly coupled to the first part. The segmented lid member is pivotable between first and second positions. In the first position, the second part of the segmented lid member covers the aperture to limit access to the interior space of the body member while, in the second position, the second part of the segmented lid is positioned to permit access to the interior space. In the second position, the second part of the segmented lid member engages at least one of the walls of the body member.

In one aspect of this embodiment of the invention, each wall of the body member and each part of the segmented lid member have inner and outer side surfaces. In this aspect, the outer side surface of the second part of the segmented lid member engages the outer side surface of at least one of the walls of the body member when the segmented lid member is in the second position.

In another aspect of this embodiment of the invention, the walls of the body member further comprises a first wall and both the first wall of the body member and the second part of the segmented lid member have inner and outer side surfaces. For this aspect, the outer side surface of the second part of the segmented lid member engages the outer side surface of the first wall of the body member when the segmented lid member is in the second position.

In still another aspect of this embodiment of the invention, the walls of the body member further comprises a first wall and both the first wall of the body member and each of the first and second parts of the segmented lid member have inner and outer side surfaces. The inner side surface of the first part of the segmented lid member is fixedly attached to the outer side surface of the first wall to fixedly attach the segmented lid member to the body member. In this aspect, the outer side surface of the second part of the segmented lid member engages the outer side surface of the first wall when the segmented lid member is in the second position.

In yet another aspect of this embodiment of the invention, the walls of the body member further comprises first and second walls and the segmented lid member further comprises a third part hingedly coupled to the second part. Each of the first and second walls of the body member and each of the first, second and third parts of the segmented lid member have inner and outer side surfaces. The inner side surface of the first part of the segmented lid member is fixedly attached to the outer side surface of the first wall of the body member to secure the segmented lid member to the body member. In this aspect, the second and third parts of the segmented lid member limit access to the interior space by covering the aperture when the segmented lid member is in the first position. Conversely, in the second position, the second and third parts of the segmented lid member are positioned to permit access to the interior space. In this position, the outer side surface of the second part of the segmented lid member engages the outer side surface of the first part of the segmented lid (which, in turn, is fixedly attached to the first wall of the body member) and the outer side surface of the third part of the segmented lid member engages the outer side surface of the second wall of the body member.

In still yet another aspect of this embodiment of the invention, the jewelry box further comprises an insert for supportably holding an item of jewelry. The insert is insertably received within the interior space of the body member and supported, within the interior space, by the walls of the body member.

In another embodiment, the present invention is directed to a jewelry box which includes a body member and a segmented lid member. The body member includes walls which collectively define an aperture for accessing an interior space thereof and include first, second and third walls. The segmented lid member, on the other hand, includes a first part fixedly attached to the body member, a second part hingedly coupled to the first part, a third part hingedly attached to the second part and a fourth part hingedly attached to the third part. Each of the first, second and third walls of the body member and the first, second, third and fourth parts of the segmented lid member have inner and outer side surfaces. Of these, the inner side surface of the first part of the segmented lid member is fixedly attached to the outer side surface of the first wall of the body member to secure the segmented lid member to the body member.

In this embodiment, the segmented lid member is pivotable between first and second positions. In the first position, the second and third parts of the segmented lid member limit access to the interior space by covering the aperture when the segmented lid member is in the first position. The segmented lid member is secured in this position by insertion of the fourth part of the segmented lid member in a slot located between the insert and the inner side surface of the third wall of the body member. Conversely, in the second position, the outer side surfaces of the second, third and fourth parts of the segmented lid member engage the outer side surfaces of the first part of the segmented lid member, the second wall of the body member and the second wall of the body member, respectively, to permit access to the interior space.

For each aspect of these embodiments of the invention, the jewelry box may further comprise a sheath attached to the inner side surface of the second part of the segmented lid.

In still another embodiment, the present invention is directed to a jewelry box having a tray structure and a segmented lid member. A first part of the segmented lid member is secured to the tray structure and a second part of the segmented lid member is hingedly coupled to the first part. The segmented lid member is pivotable between first and second positions. In the first position, the second part of the segmented lid member blocks access to the interior area of the tray structure while, in the second position, the second part of the segmented lid member permits access to the interior area of the tray structure. Instead, in the second position, the segmented lid member engages the tray structure.

In one aspect thereof, the tray structure is comprised of bottom, front, first side, rear, and second side walls. The front, first side, rear, and second side walls are fixedly attached to the first side, rear side, second side, and rear and front side walls, respectively. Further, each of the front, first side, rear, and second side walls are fixedly attached to the bottom wall. In another aspect thereof, the second part of the segmented lid member includes inner and outer side surfaces. For this aspect of the invention, in the first position, the inner side surface of the second part of the segmented lid member engages the upper edge surfaces of the first side, rear and second side walls to cover the interior area of the tray structure.

In still yet another embodiment of the invention, the present invention is directed to a jewelry box having a bottom wall, a front wall, a first side wall, a rear wall, a second side wall and a segmented lid structure. The front, first side, rear, and second side walls are fixedly attached to the first side, rear side, second side, and rear and front side walls, respectively. Further, each of the front, first side, rear, and second side walls are fixedly attached to the bottom wall. Collectively, the bottom, front, first side, rear, and second side walls define a tray structure having an interior area. The segmented lid structure is attached to the tray structure and is pivotable between first and second positions. The segmented lid structure includes a first part, a second part hingedly coupled to the first part, a third part hingedly coupled to the second part and a fourth part hingedly coupled to the third part. Inner side surfaces of the first and second parts of the segmented lid structure are fixedly secured to outer side surfaces of the bottom and rear walls, respectively. In the first position, the inner side surface of the third part of the segmented lid structure engages the first side, rear and second side walls of the tray structure to cover a first portion of the interior area of the tray structure and the inner side surface of the third part of the segmented lid structure engages the first and second side walls of the tray structure to cover a second portion of the interior area of the tray structure. In the second position, the outer side surface of the third part of the segmented lid structure engages the outer side surface of the second part of the segmented lid structure and the outer side surface of the fourth part of the segmented lid structure engages the outer side surface of the first part of the segmented lid structure. In this position, the segmented lid structure no longer blocks access to the interior area of the tray structure.

In one aspect of this embodiment of the invention, the third part of the segmented lid structure can pivot approximately 270 degrees in a first direction along an axis of rotation relative to the second part of the segmented lid structure while the fourth part of the segmented lid structure can pivot approximately 180 degrees in the first direction along the axis of rotation relative to the third part of the segmented lid structure. In this aspect, when moving from the first position to the second position, the third part of the segmented lid structure pivots approximately 270 degrees (relative to the second part of the segmented lid structure) in the first direction and the fourth part of the segmented lid structure pivots approximately an additional 90 degrees (relative to the third part of the segmented lid structure) in the first direction along the axis of rotation.

In an alternate aspect of this embodiment of the invention, the second part of the segmented lid structure is generally orthogonal to the first part of the segmented lid structure, the third part of the segmented lid structure is generally orthogonal to the second part of the segmented lid structure and generally parallel with the first part of the segmented lid structure and the fourth part of the segmented lid structure is generally planar to the third part of the segmented lid structure when the segmented lid structure is in the first position. Conversely, in the second position, the third part of the segmented lid structure is generally parallel to the second part of the segmented lid structure and generally orthogonal to the first part of the segmented lid structure while the fourth part of the segmented lid structure is generally orthogonal to the second and third parts of the segmented lid structure and generally parallel to the first part of the segmented lid structure.

In a further aspect of this alternate aspect of the invention, the jewelry box further comprises an insert received within the interior space of the tray structure and supportably mounted by the inner side surface of the bottom wall. In another, the structured lid member further comprises a fifth part hingedly attached to the fourth part. When the segmented lid structure is in the first position, the fifth part of the segmented lid structure is generally orthogonal to the fourth part of the segmented lid structure. Conversely, when the segmented lid structure is in the second position, the fifth part of the segmented lid structure is generally planar with the fourth part of the segmented lid structure. Alternately, the fifth part of the segmented lid structure is capable of pivoting, in a first direction along an axis of rotation, approximately 270 degrees relative to the fourth part of the segmented lid structure and, in a second direction along the axis of rotation, approximately 90 degrees relative to the fourth part of the segmented lid structure. Alternately again, in the first position, the fifth part of the segmented lid structure is generally orthogonal to the fourth part of the segmented lid structure and is insertably received in a slot between the insert and the inner side surface of the front wall to secure the segmented lid structure in the first position. Conversely, in the second position, the fifth part of the segmented lid structure is generally planar with the fourth part of the segmented lid structure. In pivoting from the first position to the second position, the fifth part of the segmented lid structure pivots 90 degrees relative to the fourth part of the segmented lid structure.

In still further aspects of this alternate aspect of the invention, the jewelry box further includes a sheath attached to the inner side surface of the third part of the segmented lid structure, at least one character imprinted on the inner side surface of the fifth part of the segmented lid structure and/or at least one character imprinted on the outer side surface of the fourth part of the segmented lid structure.

DETAILED DESCRIPTION

Figure 1:
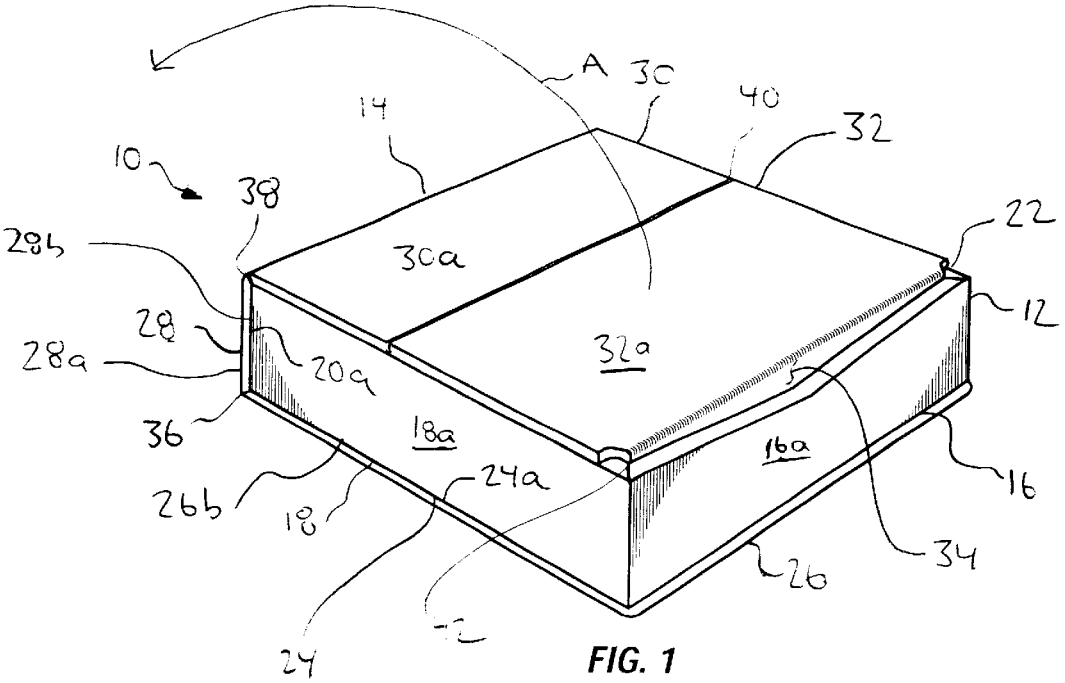
FIG. 1 is a perspective view of a jewelry box constructed in accordance with the teachings of the present invention and having an attached segmented lid member in a first, closed, position in which the segmented lid member blocks access to an interior area of the jewelry box.

Referring now to the drawings, the reference numeral 10 designates a jewelry box 10 constructed in accordance with the teachings of the present invention. The jewelry box 10 includes a main body member 12 and a segmented lid member 14. As will be more fully described below, the segmented lid member 14 includes segments fixedly attached to the main body member 12 as well as segments pivotable with respect to the main body member 12. First, it should be clearly understood that the jewelry box 10 may be alternately configured to omit the fixed segments of the segmented lid member 14 without departing from the scope of the present invention. In such alternate embodiments, the pivotable segments of the segmented lid member 14 would be hinged or otherwise affixed to the main body member 12. It should be further understood that, while the fixedly attached segments of the segmented lid member 14 are described as part of the segmented lid member 14, it is fully contemplated that, in alternate embodiments of the invention, the fixedly attached segments may be viewed as forming part of the main body member 12 or forming part of the segmented lid member 14.

The main body member 12 includes a front wall 16, a first side wall 18, a rear wall 20, a second side wall 22 and a bottom wall 24, each of which are generally planar in shape. Side surfaces of the front, first side, rear, second side and bottom walls 16, 18, 20, 22 and 24 of the main body member 12 are fixedly mounted to each other using a conventional mounting techniques, for example, using an adhesive material such as a glue applied between the side surfaces, to form a tray structure. For example, inner side surfaces 16*b*, 18*b*, 20*b* and 22*b* of the front, first side, rear and second side walls 16, 18, 20 and 22 may be fixedly attached to respective edge side surfaces 24*c* of bottom wall 24. Of course, it is fully contemplated that the front, first side, rear, second side and bottom walls 16, 18, 20, 22 and 24 may be attached to one another in various configurations and/or using various types of adhesives without departing from the scope of the present invention.

Preferably, the front, first side, rear, second side and bottom walls 16, 18, 20, 22 and 24 are all formed of a stiffened material, for example, cardboard, which resists folding or bending of the walls 16, 18, 20, 22 and 24 from their respective generally planar shapes. To enhance attractiveness of the jewelry box 10, the front, first side, rear, second side and bottom walls 16, 18, 20, 22 and 24 may be wrapped in a layer (not shown) of a suitable covering material. For example, leatherette or another type of polyurethane may be used as the covering material. Of course, to reduce cost of the layer of covering material, it is contemplated that the leatherette or other suitable covering material be used to cover only those surfaces of the main body member 12 which are visible when the jewelry box 10 is fully assembled. Typically, the visible surfaces of the main body member 12 would be outer and inner side surfaces 16*a* and 16*b*, 18*a* and 18*b*, 22*a* and 22*b* of the front, first side and second side walls 16, 18 and 22, inner side surface 20*b* of the rear wall 20 and outer side surface 24*a* of the bottom wall 24. As will be more fully described below, in the specific embodiment of the invention disclosed herein, when the jewelry box 10 is fully assembled, outer side surface 20*a* of the rear wall 20 is not visible due to the manner in which the segmented lid member 14 is attached to the main body member 12. However, it is fully contemplated that the segmented lid member 14 may be attached to the main body member 12 in various other manners, for example, using a hinge which pivotally attaches an edge side surface of the segmented lid member 14 to an edge side surface of the rear wall 20 of the main body member 12, such that the outer side surface 20*a* of the rear wall 20 is visible, while fully remaining within the scope of the present invention.

As may be further seen in FIG. 1, the front, first side, rear, second side and bottom walls 16, 18, 20, 22 and 24 which collectively comprise the tray structure are generally rectangular in shape. For example, in one configuration which has proven suitable for the uses contemplated herein, the bottom wall 24 may be formed in a generally rectangular shape having a length of approximately 3¾ inches long and a width of approximately 3¼ inches, the first and second side walls 18 and 22 may be formed in generally rectangular shapes, each having a length of approximately 3¾ inches long and a height of approximately 1¼ inches high and the front and rear walls 16 and 20 may be formed in generally rectangular shapes, each having a width of 3½ inches and a height of approximately 1¼ inches. Of these, the front wall 16 has a generally v-shaped taper formed in the aforementioned generally rectangular shape to enhance openability of the jewelry box 10. More specifically, a top edge side surface has a gradual, height reducing taper which extends from both the first and second edge side surfaces and reaches its deepest point at a central axis of the front wall. For example, the tapered front wall has a height of 1¼ inches at each of the first and second edge side surfaces and a height of 1⅛ inches along a central axis thereof. Of course, both the shape and dimensions of the front, first side, rear, second side and bottom walls 16, 18, 20, 22 and 24 are provided purely by way of example and it is specifically contemplated that walls having other shapes and/or dimensions are suitable for the uses contemplated herein.

The segmented lid member 14 is comprised of first, second, third, fourth and fifth parts 26, 28, 30, 32 and 34. While it is contemplated that the segmented lid member 14 may be formed of a single, generally planar, sheet of material which is folded into the first, second, third, fourth and fifth parts 26, 28, 30, 32 and 34, in the embodiment of the invention disclosed herein, each of the first, second, third, fourth and fifth parts 26, 28, 30, 32 and 34 of the segmented lid member 14 is comprised of respective generally planar inserts formed of a stiffened material such as cardboard or metal which resists bending. As previously mentioned, in one embodiment of the invention, the third, fourth and fifth segments 30, 32 and 34 form a "lid member" of the jewelry box 10 while the first and second segments 26 and 28 form part of the "main body member" of the jewelry box 10. In another, the first, second, third, fourth and fifth segments collectively form the "lid member" for the jewelry box 10.

The first and second parts 26 and 28 of the segmented lid member 14 are fixedly attached to the main body member 12. Specifically, an inner side surface 26*b* of the first part 26 is fixedly attached to an outer side surface 24*a* of the similarly dimensioned bottom wall 24 and an inner surface 28*b* of the second part 28 is fixedly attached to an outer side surface 20*a* of the similarly dimensioned rear wall 20. As the bottom and back wall 18 and 24 are generally orthogonal to each other, the first and second parts 26 and 28 are also bent at a generally orthogonal angle relative to each other before attachment to the corresponding one of the bottom and back walls 24 and 18. Further, as the first and second parts 26 and 28 of the segmented lid member 14 are mounted to the bottom and rear walls 24 and 20 of the main body portion 12, respectively, it is contemplated that the inserts for the first and second parts 26 and 28 are constructed to be relatively thin, for example, by forming the inserts using a single sheet of cardboard. Conversely, as the third and fourth parts 30 and 32, which collectively form a "lid portion" of the lid member for the jewelry box 10, and the fifth part 34, which forms an insertable securing "flap" for the lid portion of the jewelry box 10, it is contemplated that the inserts for the third, fourth and fifth parts 30, 32 and 34 are formed using a thicker (and typically more inflexible) insert. For example, metal, fiberboard or even a thicker sheet of cardboard are suitable for use as the third, fourth and fifth parts 30, 32 and 34 of the segmented lid member 14. The inserts are then wrapped by a common layer of leatherette or other covering material. As before, the covering layer may wrap the entire segmented lid member 14 in the same leatherette material or, if reduced manufacturing costs are desired, wrap only those portions of the segmented lid member 14 which are visible when the jewelry box 10 is fully assembled in leatherette while the remaining portions are wrapped in a less expensive covering. The single piece, i.e., the segmented lid member 14, produced by wrapping the parts 26, 28, 30, 32 and 34 with a common layer of covering material is relatively inflexible where the inserts underlie the covering layer but readily bendable along junctures where adjacent inserts abut one another. In this manner, each part is hingedly attached to an adjacent part. More specifically, hinge 36 attaches the first part 26 to the second part 28, hinge 38 attaches the second part 28 to the third part 30, hinge 40 attaches the third part 30 to the fourth part 32 and hinge 42 attaches the fourth part 32 to the fifth part 34.

As the first and second parts 26 and 28 of the segmented lid member 14 are fixedly attached to the bottom and rear walls 24 and 20 of the tray structure, certain sides of the jewelry box 10 may appear to have greater thickness than other sides thereof. If such an effect is undesired, it is contemplated that either the bottom and rear walls 24 and 20 may be configured to have a reduced thickness when compared to the front, first side and second side walls 16, 18 and 22. Alternately, the first and second parts 26 and 28 may be configured to have a reduced thickness when compared to the third, fourth and fifth parts 30, 32 and 34.

As disclosed herein, the hinges 38, 40 and 42 are formed by the juncture of adjacent metal inserts wrapped in a shared layer of covering material. It is fully contemplated, however, that, in an alternate embodiment of the invention not shown in the drawings, one or more of the parts 30, 32 or 34 could be a discrete piece which is hingedly attached to the remainder of the segmented lid member 14 by a combination bracket/hinge pin structure or another well known type of hinge structure.

Depending on the position of the various parts 26, 28, 30, 32 and 34 of the segmented lid member 14 relative to the front, rear and bottom walls 16, 20 and 24 of the main body portion 12, the range of pivot action will differ for various ones of the hinges 36, 38, 40 and 42. The range of pivot action for certain ones of the hinges 36, 38, 40 and 42 will further vary depending on how others ones of the hinges 36 38, 40 and 42 are pivoted. More specifically, as inner side surfaces 26*b* and 28*b* of the first and second parts 26 and 28 of the segmented lid member 14 are fixedly attached to outer side surfaces 24*a* and 20*a* of the bottom and rear walls 24 and 20 respectively, for example, using a glue or other conventional adhesive material. Thus, while technically still a "hinge", the hinge 36 is fixed in a position where the first and second parts 26 and 28 of the segmented lid member 14 are generally orthogonal to one another.

While the second part 28 of the segmented lid member 14 is fixedly attached to the main body portion 12, the third part 30 of the segmented lid member is unattached to the main body portion 12. As a result, the hinge 38 pivotably couples the third part 30 to the second part 28. The third part 30 is capable of pivoting up to 270 degrees from a first, or closed, position illustrated in FIG. 1 in which an inner side surface 30*b* of the third part 30 engages upper edge side surfaces of the first side, rear and second side walls 18, 20 and 22 to a second, or fully open, position illustrated in FIG. 2 in which the outer side surface 30*a* of the third part 30 engages the outer side surface 28*a* of the second part 28.

Like the third part 30, the fourth part 32 is unattached to the main body portion 12. Here, however, the fourth part 32 is attached to the third part 30 by hinge 40. As a result, the hinge 40 enables the fourth part 32 to pivot up to approximately 180 degrees in either direction relative to the third part 30. Of course, the main body portion 12 may variously limit the pivot action of the fourth part 32, depending on the positioning of the third part 30 relative to the main body portion 12. For example, from the closed position shown in FIG. 1, the fourth part 32 can be pivoted 180 degrees (or until the outer side surface 32*a* engages the outer side surface 30*a* of the third part 30. Conversely, upper edge side surfaces of the first and second side walls 18 and 22 block the fourth part 32 from downward pivoting when the segmented lid member 14 is in the closed position illustrated in FIG. 1.

Like the fourth part 32, the fifth part 34 is unattached to the main body portion 12. Here, however, the fifth part 34 is attached to the fourth part 32 by hinge 42. As a result, the hinge 42 enables the fifth part 34 to pivot, in response to an appropriate biasing force, nearly 360 degrees, from a first position in which the outer side surface 32*a* of the fifth member 34 engages the outer side surface 32*a* of the fourth part 32 to a second position in which an inner side surface 34*b* of the first part 34 engages an inner side surface 32*b* of the fourth part 32. Of course, when the segmented lid member 14 is in the first, closed, position illustrated in FIG. 1, the fifth part 34 is prevented from pivoting in either direction by the front wall 16 and insert 44, respectively.

It should be noted that, unlike the third and/or fourth parts 30 and 32, in the closed position illustrated in FIG. 1, the fifth part 34 does not have upper edge surfaces of the first side, rear and/or second sides 18, 20 and 22 of the main body portion 12 for support. As a result, in the first, closed, position, the weight of the fifth part 34 tends to bias the hinge 42 such that, when the fourth part 32 is held in a generally horizontal plane such as that illustrated in FIG. 1, the first part 34 will tend to descend downwardly relative thereto. The angle of downward descent for the fifth part 34 will vary depending on a number of factors, including the weight of the fifth part 34 and to what extent the layer of covering material limits movement of the fourth and fifth parts 32 and 34 relative to one another. Typically, however, absent any other biasing forces, the fifth part 34 will be downwardly angled between about 45 and 60 degrees relative to the fourth part 32.

Collectively referring to FIGS. 1–6, various uses of jewelry box 10 made possible by use of the attached segmented lid member 14 disclosed herein will now be described in greater detail. As previously set forth, one objective of the present invention is to provide a jewelry box 10 in which an attached lid part thereof, here, the third, fourth and fifth parts 30, 32 and 34 of the segmented lid member 14 may be "hidden from view." As used herein, the term "hidden from view" is intended to refer to those arrangements of the segmented lid member 14 which result in one or more parts thereof not being readily apparent when the jewelry box 10 is viewed from the front—the view which prospective purchasers of the jewelry box 10 are typically afforded. To hide the third, fourth and fifth parts 30, 32 and 34 of the segmented lid member 14 from view, the hidden parts are variously placed underneath or behind the main body portion 12 of the jewelry box 10. It should be noted, however, that for certain arrangements of the segmented lid member 14, certain parts of the segmented lid member 14 may be hidden from view behind other parts of the segmented lid member 14. By hiding one or more parts of the segmented lid member 14 from the view of prospective purchasers, a jewelry box that is particularly well suited for use as part of a display in that minimal distraction from the item of jewelry being displayed in the jewelry box 10 results when parts of the segmented lid member 14 are hidden from view.

Figure 2:
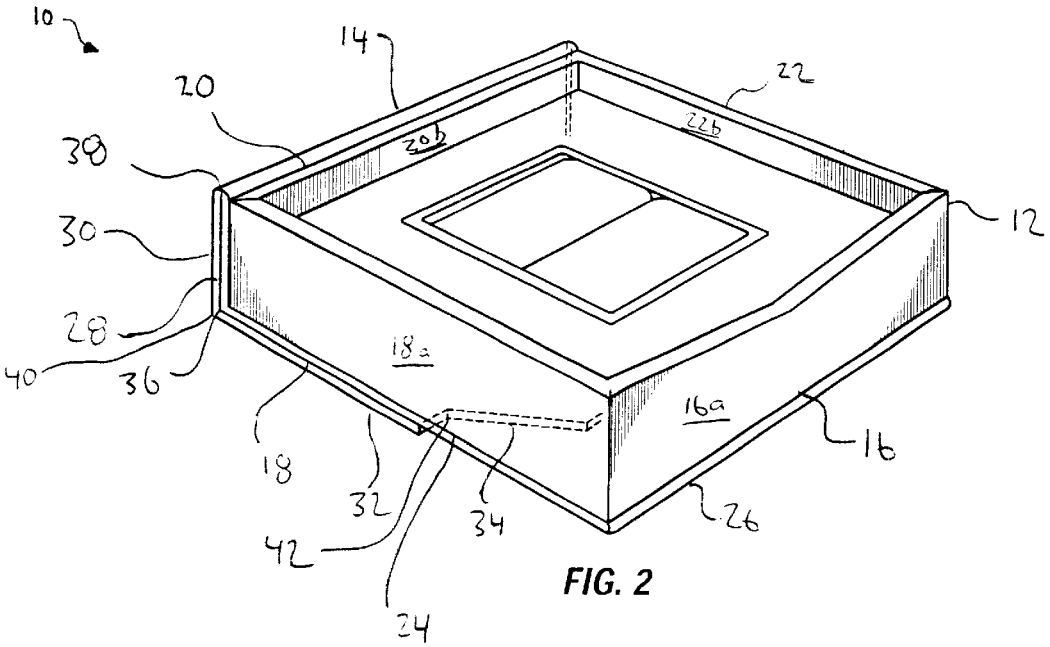
FIG. 2 is a perspective view of the jewelry box of FIG. 1 with the segmented lid member in a second, fully open, position in which access to the interior area of the jewelry box is permitted and in which the segmented lid member is predominately hidden from view.

To reconfigure the jewelry box from a first, closed, position, illustrated in FIG. 1, in which the third and fourth parts 30 and 32 of the segmented lid member 14 block access to the interior of the jewelry box 10 and the fifth part 34 of the segmented lid member 14 is received within a slot (not visible) between the inner side surface 16*b* of the front wall 16 and the insert 44 to secure the segmented lid member 14 in the first position to a second, fully open, position, illustrated in FIG. 2 in which the third, fourth and fifth parts 30, 32 and 34 of the segmented lid member 14 are hidden from view, specifically, by placing the third member 30 behind the rear wall 20 and placing the fourth and fifth members 32 and 34 underneath the main body portion 12,the third part 30 of the segmented lid member 14 is grasped and the pivotable parts of the segmented lid member 14, i.e., the third, fourth and fifth parts 30, 32 and 34, are pivoted in a first direction along pivot axis A. From its initial position (in FIG. 1) engaging upper edge side surfaces of the first side, rear and second side walls 18, 20 and 22 to partially cover the interior of the jewelry box, the third part 30 is pivoted 270 degrees around the hinge 38 (or until its outer side surface 30*a* engages the outer side surface 28*a* of the second part 28). Once the outer side surfaces 30*a*, 28*a* engage, the fourth part 32 (which, apart from some incidental movement resulting from the pivoting of the third part 30, has remained in a plane with the third part 30) and the fifth part 34 (which, apart from some incidental movement resulting from either the pivoting of the third part 30 and/or removal of the fifth part 34 from the slot between the insert 44 and the front wall 16), are pivoted an additional 90 degrees such that the outer side surface 32*a* of the fourth part 32 engages the outer side surface of the first part 26*a*. The fifth part 43 would then be pivoted still another 90 degrees such that the outer side surface 34*a* of the fifth part 34 also engages the outer side surface 26*a* of the fifth part. By pivoting the third, fourth and fifth parts 30, 32 and 34 of the segmented lid member 14 in this manner, the fourth and fifth parts 32 and 34 of the segmented lid member 14 are placed beneath the bottom wall 24 of the main body portion 12 while the third part 30 of the segmented lid member 14 is place behind the rear wall 20 of the main body portion 12. It should be noted, however, that while the pivoting of the third, fourth and fifth parts 30, 32 and 34 of segmented lid member 14 is described as a series of steps, each including specified extent to which selected ones of the parts 30, 32 and 34 are pivoted in each step, it should be clearly understood that the described process is purely exemplary and that, in repositioning the segmented lid member 14 from the first, closed, position illustrated in FIG. 1 to the second, fully open, position illustrated in FIG. 2, various ones of the parts 30, 32 and 34 of the segmented lid member 14 may be pivoted alone or collectively in any desired sequence so long as the desired end result is achieved. Indeed, as noted below, in order to pivot the third part 30 as described herein, the fourth or fifth part 32 or 34 must be grasped and pivoted with the third part 30.

One additional advantage achieved by the use of the segmented lid structure 14 disclosed and illustrated herein is that, when closed, the lid structure 14 is highly resistant to accidental openings of the jewelry box 10 which can contribute to the loss of the jewelry item held thereby. More specifically, as previously set forth, the segmented lid structure 14 includes three pivotable members-the third, fourth and fifth parts 30, 32 and 34. Of these, the third and fourth parts 30 and 32 cover the opening of the tray structure 12 while the fifth part 34 is inserted within a slot between the insert 44 and the front wall 16 to secure the segmented lid member 14 in the closed position. It has been discovered that use of the segmented lid member 14 enhances securement of the jewelry box 10 in the closed position. Specifically, to open the jewelry box 10, a biasing force must be exerted along axis A on that portion of the segmented lid structure 14 which covers the interior opening of the main body portion 12. However, because the portion of the segmented lid structure 14 covering the opening is segmented into the third and fourth parts 30 and 32, if the biasing force is applied to the third part 30, rather than opening the jewelry box, the fifth part 34 will be biased into engagement with the insert 44. As a result, the segmented lid structure 14 resists opening when biasing force is applied to the third part 30 thereof. In contrast, if a similar biasing force was applied to the same location in a one-piece lid structure, the jewelry box would open in response thereto.

Figure 3:
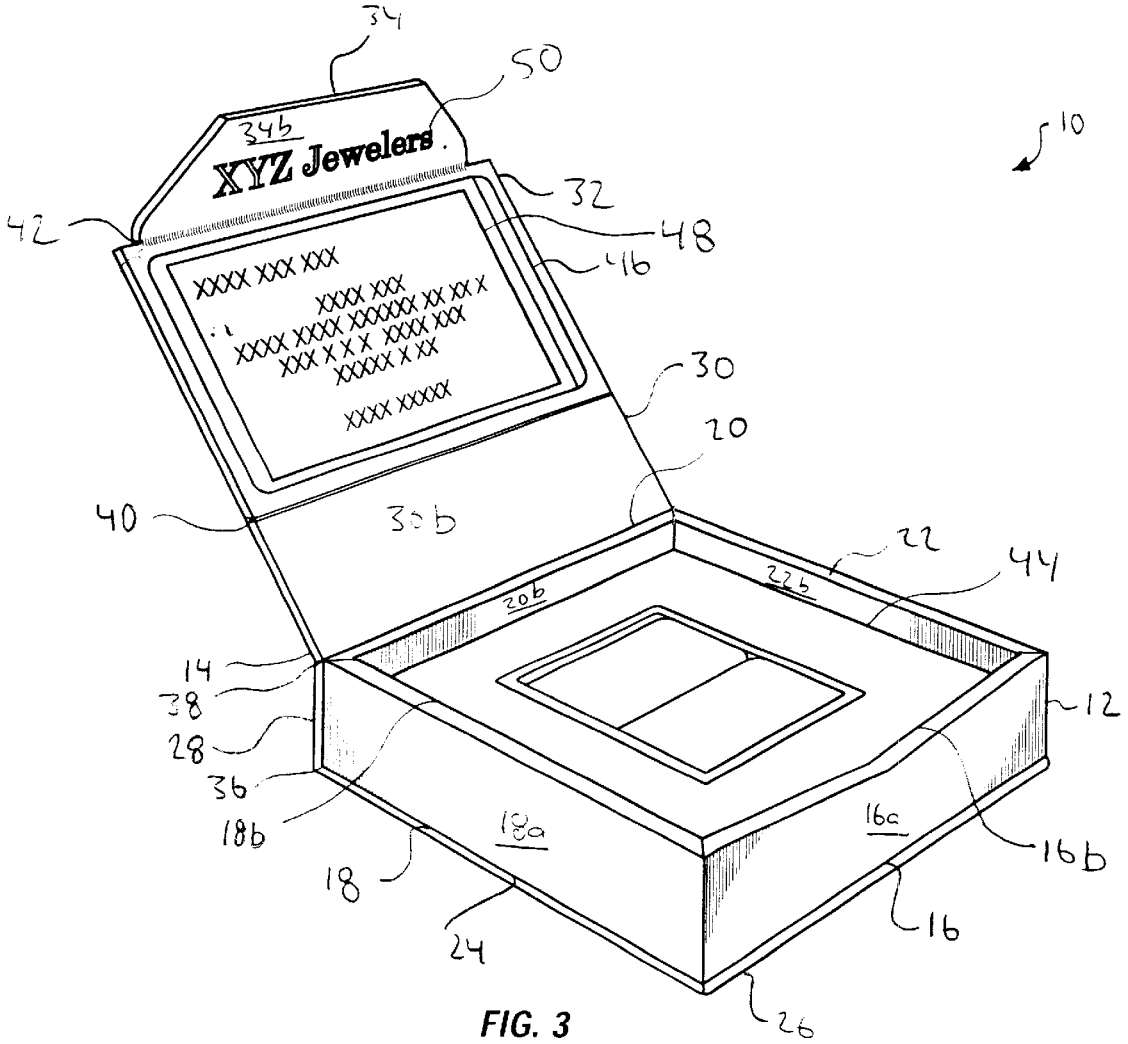
FIG. 3 is a perspective view of the jewelry box of FIGS. 1–2 with the segmented lid member in a third, partially open, position in which access to the interior area of the jewelry box is permitted and in which inner side surfaces of fourth and fifth parts of the segmented lid member are visible for use as part of a display.

While one benefit achieved by the present invention of a jewelry box 10 having a segmented lid member 14 is the aforementioned ability to hide selected portions of the segmented lid member 14 from view, it should be further noted that numerous other benefits are derived from a jewelry box configured in the manner disclosed herein. One such benefit is that the jewelry box 10 enables a certificate of authenticity to be carried with the jewelry box 10 itself. In this regard, FIG. 3 shows the segmented lid member 14 of the jewelry box 10 in a third, partially open, position. As may now be seen, the jewelry box 10 also provides for the storage of a certificate of authenticity. Specifically, a sheath 46, preferably formed of a generally transparent, plastic material is carried on the inner side surface 32*b* of the fourth part 32. While it is fully contemplated that the sheath 46 may instead be formed of an opaque material, a generally transparent material is preferred so that, when the jewelry box 10 is configured in one of the partially opened positions illustrated in FIGS. 3, 4 or 5, the certificate of authenticity 48 supported within the sheath 46 may be viewed by prospective purchasers. It is further contemplated that the sheath 46 may be constructed using a variety of techniques. For example, a first sheet of material may be mounted to the inner side surface 32*b* of the fourth part 34, for example, using a layer of adhesive. A second, similarly dimensioned sheet of material may then be heat sealed to the first sheet of material along three sides thereof to form the sheath 46. While the sheath 46 may be variously sized, preferably, it should be suitably dimensioned to receive a certificate of authenticity 48 therein. In this manner, the sheath 46 enables the retailer and the ultimate purchaser to store the certificate of authenticity 48 with the jewelry box 10 where it is less likely to become lost or otherwise disassociated.

The sheath 46 may also be used to enhance the sales appeal of a diamond ring or other jewelry item being displayed in the jewelry box 10 by enabling the retailer to place the certificate of authenticity 48 in close proximity to the item of jewelry where the certificate of authenticity 48 can be easily examined by potential purchasers. For example, rather than hiding the third, fourth and fifth parts 32 and 34 of the segmented lid member 14 behind the rear wall 20 and/or underneath the bottom wall 24 of the jewelry box 10, the third, fourth and fifth parts 30, 32 and 34 may instead be pivoted to a third, partially open position illustrated in FIG. 3 where both the insert 44 supporting the item of jewelry and the sheath 46 carrying the certificate of authenticity 48 are clearly visible. For example, the third, fourth and fifth parts 30, 32 and 34 may be simultaneously pivoted, from the closed position illustrated in FIG. 1, roughly 135 degrees along axis A to the third, partially open, position illustrated in FIG. 3. As may now be seen, not only is the certificate of authenticity 48 carried within the jewelry box 10, it is now clearly visible to a potential purchaser who stops to examine an item of jewelry on display within the jewelry box 10, particularly since the certificate of authenticity 48 is elevated above the main body portion 12.

If desired, the fifth part 34 of the segmented lid member 14 may be used to still further enhance the commercial appeal of the jewelry box 10 by imprinting at least one character 50 on the inner side surface 34*b* of the fifth part 34. For example, the at least one character 50 imprinted on the inner side surface 34*b* of the fifth part 34 may be the name of the retailer offering the item of jewelry for sale or an appealing artistic design. Of course, to enhance visibility of the at least one character 50 imprinted on the inner side surface 34*b*, it may be necessary to pivot the fifth part 34 an additional 30 degrees along the axis A relative to the third and fourth parts 30 and 32.

Of course, for the segmented lid member 14 of the jewelry box 10 to maintain the position illustrated in FIG. 3, it may be necessary to increase the resistance of the hinges 38, 40 and 42 to pivoting, for example, by reducing the amount of covering material used to wrap the segmented lid member 14 at the juncture of the third and fourth parts 30 and 32 and at the juncture of the fourth and fifth parts 32 and 34. Alternately, the weight of the segmented lid member 14 may be reduced, for example, by substituting a light weight composite material for the metal inserts used for one or more of the third, fourth and fifth parts 30, 32 and 34.

While, in the embodiment of the invention disclosed herein, the sheath 46 is used to hold the certificate of authenticity 48, it is further contemplated that the sheath 46 may be used to hold other items, either in place of, or in conjunction with, the certificate of authenticity 48. For example, while many salespersons carry business cards for distribution to potential and actual purchasers, oftentimes, there is little likelihood that a purchaser will keep the business card. If, however, the business card is inserted within the sheath 46, it is much more likely that the business card will be kept by the purchaser for longer periods of time. This enhances the likelihood that the salesperson may develop a long term relationship by making it easier for the purchaser to return to the same salesperson for repeat sales.

Figure 4:
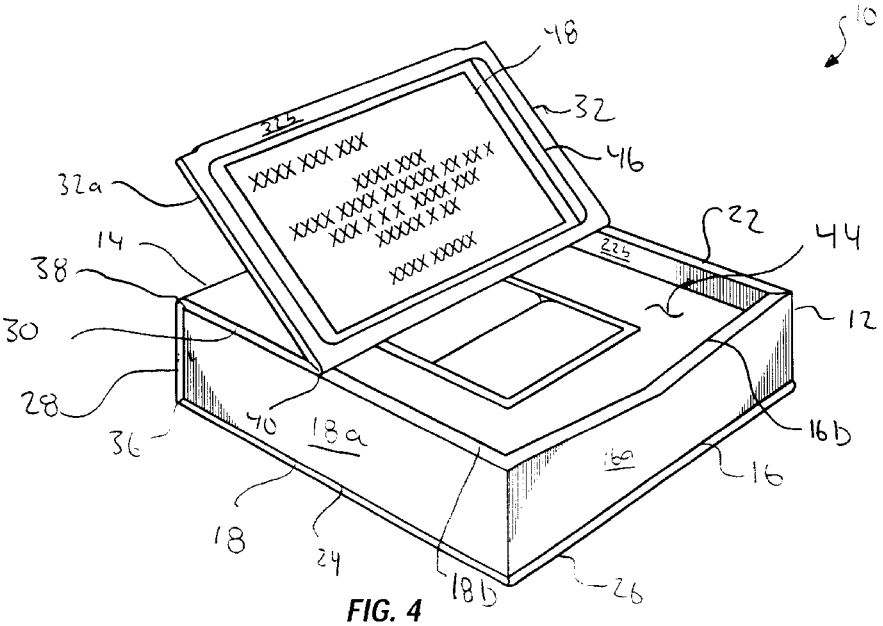
FIG. 4 is a perspective view of the jewelry box of FIGS. 1–3 with the segmented lid member in a fourth, partially open, position in which access to the interior area of the jewelry box is permitted and in which the inner side surface of a fourth part of the segmented lid member is visible for use as part of a display while the third and fifth parts of the segmented lid member are predominately hidden from view.
Figure 5:
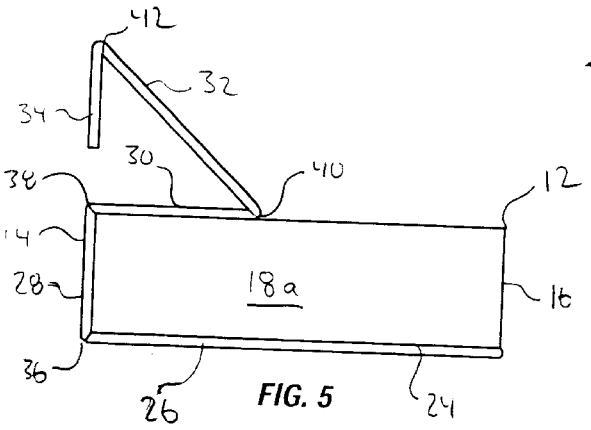
FIG. 5 is a side view of the jewelry box of FIGS. 1–3 in the fourth, partially open, position illustrated in FIG. 4.

It is further contemplated that the segmented lid member 14 may be used in a wide variety of display designs. For example, segmented lid member 14 may be positioned that the inner side surface 32*b* of the fourth part 32 which carries the sheath 46 is clearly visible to potential purchasers while the fifth part 34 of the segmented lid member 14 is hidden from view and the insert 44 is partially obscured. More specifically, the segmented lid member 14 may be pivoted from the closed position illustrated in FIG. 1 to a fourth, partially open, position illustrated in FIGS. 4 and 5 by maintaining the engagement between the inner side surface 34*b* of the third member 30 with the upper edge side surfaces of the first side, rear and second side walls 18, 20 and 22 of the main body portion 12 while pivoting the fourth and fifth parts approximately 135 degrees along axis A. After pivoting the fourth part 32 of the segmented lid member 14 to the position illustrated in FIG. 4, the fifth part 34 of the segmented lid member 14 is further pivoted along axis A until hidden behind the fourth part 32 of the segmented lid member 14. For example, FIGS. 4 and 5 show the fifth member 34 pivoted roughly an additional 225 degrees along the axis A. As before, it may be necessary to vary the resistance of the hinges 40 and 42 in order to ensure that the fourth and fifth parts 30 and 32 of the segmented lid member 14 stay in position illustrated in FIGS. 4 and 5.

Figure 6:
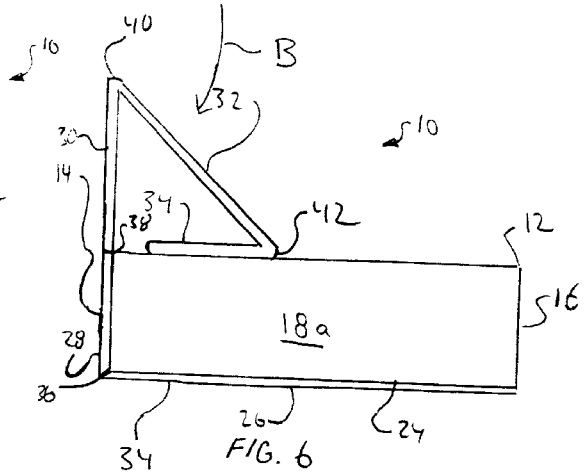
FIG. 6 is a side view of the jewelry box of FIGS. 1–3 with the segmented lid member in a fifth, partially open, position in which access to the interior area of the jewelry box is permitted and in which the outer side surface of a fourth part of the segmented lid member is visible for use as part of a display while the third and fifth parts of the segmented lid member are predominately hidden from view.

Still another attractive display configuration in which the segmented lid member may be readily positioned is illustrated in FIG. 6. Here, from the closed position illustrated in FIG. 1, the third part 30 of the segmented lid member 14 is pivoted approximately 90 degrees along axis A. Upon aligning the second and third parts 28 and 30 in the same plane, the fourth part 32 is then pivoted approximately 135 degrees along axis B (while the fifth part 34 is pivoted approximately an additional 45 degrees (or 180 degrees total) along axis B). This position has particular appeal in that the insert 44 (or even the jewelry item, if desired) may restrain the lid member in the position illustrated in FIG. 6, thereby eliminating the need to vary the resistance characteristics of the hinges 40 and 42 to ensure that the segmented lid member 14 can be positioned in the desired configuration. Furthermore, it is noted that an imprint of at least one character, if placed on the outer side surface 32*b* of the fourth part 32 of the segmented lid member 14, as well as the jewelry item on display in the jewelry box 10 will both be clearly visible to potential purchasers when the segmented lid member 14 is in the fourth, partially open, position illustrated in FIG. 6. In such a configuration, the ability of the seller to brand a diamond or other jewelry item is enhanced by the ability to place a company name in proximity to the jewelry item itself.

Figure 7:
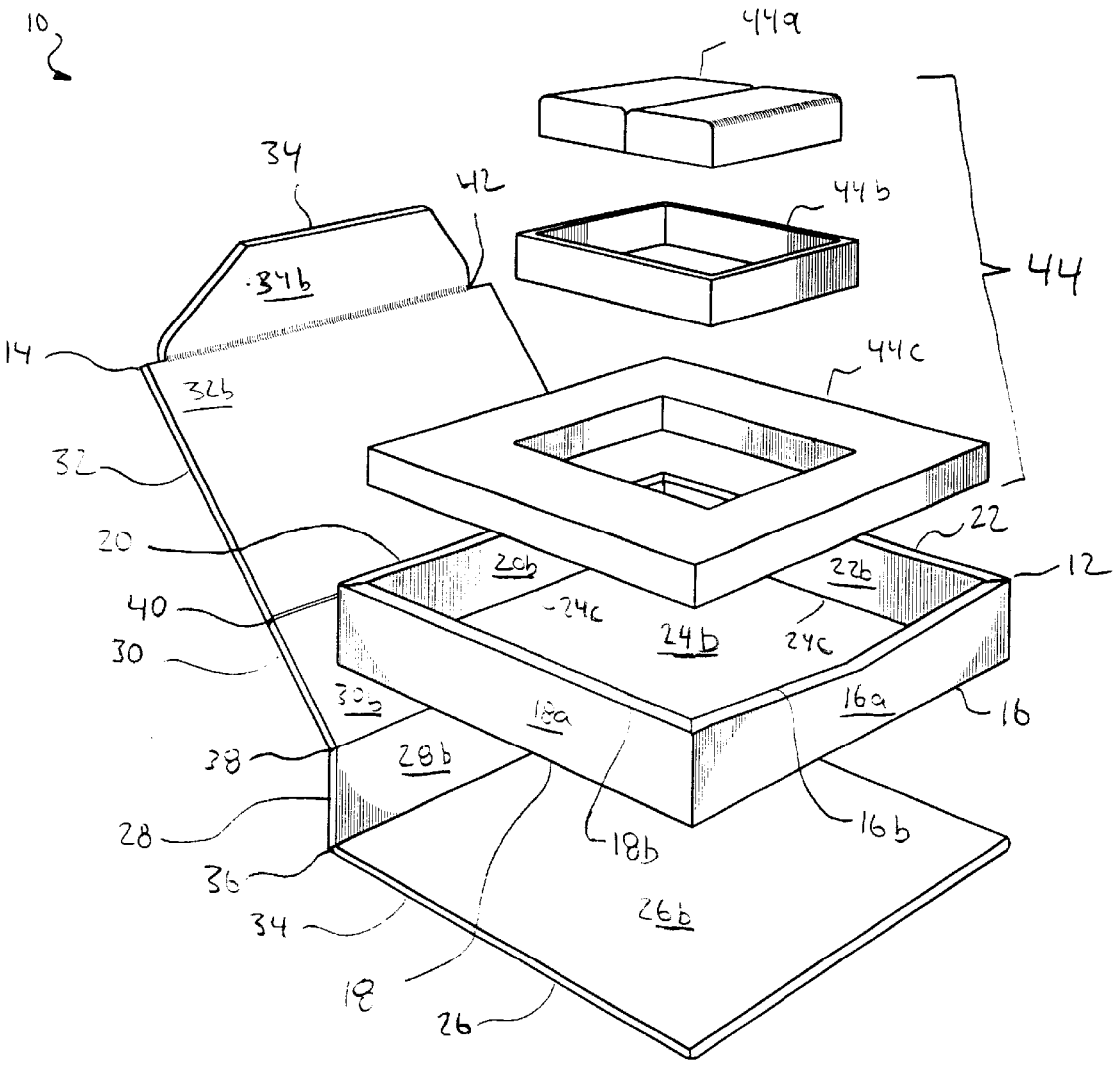
FIG. 7 is an exploded perspective view of the jewelry box of FIGS. 1–3.

Construction of the jewelry box 10 can best be seen by reference to FIG. 7. After the front, first side, rear, second side and bottom walls 16, 18, 20, 22 and 24 are affixed to one another in the illustrated manner, the inner sides 26*b* and 28*b* of the first and second parts of the segmented lid member are affixed to the outer sides 24*a*, 20*a* of the bottom and rear walls. The insert 44, which as may be best seen in FIG. 7, is comprised of a soft, deformable pad 44*a* for supporting an item of jewelry thereon, bounded by a first frame 44*b* which protects the pad 44*a* from deformation and which is bounded, in turn, by a second frame 44*c* typically used to size the pad 44*a* to the jewelry box 10, is then placed onto the inner side surface 24*b* of the bottom wall 24. After a diamond ring or other jewelry item is placed onto the pad 44*a*, the third, fourth and fifth parts 30, 32 and 34 of the segmented lid member 14 are pivoted into the closed position illustrated in FIG. 1.

Thus, there has been described and illustrated herein, a jewelry box configured to carry a certificate of authenticity while enhancing the display of an item of jewelry carried thereby by enabling an attached segmented lid member thereof to selectively be hidden from view or incorporated into the display of the jewelry item. However, those skilled in the art should recognize that, although illustrative embodiments of the invention have been shown and described, other modifications, changes, and substitutions are intended in the foregoing disclosure. Accordingly, it is appropriate that the appended claims be construed broadly and in a manner consistent with the scope of the invention.

What is claimed is:

1. A jewelry box, comprising:

a body member having walls which collectively define an aperture for accessing an interior space, each wall of said body member including inner and outer side surfaces, respectively; and a segmented lid member having a first part secured to said body member and a second part hingedly coupled to said first part, said segmented lid member pivotable between first and second positions, each part of said segmented lid member including inner and outer side surfaces, respectively;

wherein, in said first position, said second part of said segmented lid member limits access to said interior space by covering said aperture and, in said second position, said second part of said segmented lid member is positioned to permit access to said interior space, said second part of said segmented lid member engaging at least one of said walls of said body member in said second position, and wherein, in said second position, said outer side surface of said second part of said segmented lid member engages said outer side surface of at least one of said walls of said body member.

2. The jewelry box of claim 1 and further comprising a sheath attached to said inner side surface of said second part of said segmented lid member.

3. A jewelry box, comprising:

a body member having walls which collectively define an aperture for accessing an interior space, said walls of said body member including a first wall having inner and outer side surfaces; and a segmented lid member having a first part secured to said body member and a second part hingedly coupled to said first part, said segmented lid member pivotable between first and second positions, said second part of said segmented lid member including inner and outer side surfaces;

wherein, in said first position, said second part of said segmented lid member limits access to said interior space by covering said aperture and, in said second position, said second part of said segmented lid member is positioned to permit access to said interior space, said second part of said segmented lid member engaging at least one of said walls of said body member in said second position, and wherein, in said second position, said outer side surface of said second part of said segmented lid member engages said outer side surface of said first wall.

4. The jewelry box of claim 3 and further comprising a sheath attached to said inner side surface of said second part of said segmented lid member.

5. A jewelry box, comprising:

a body member having walls which collectively define an aperture for accessing an interior space, said walls of said body member including a first wall having inner and outer side surfaces; and a segmented lid member having a first part secured to said body member and a second part hingedly coupled to said first part, said segmented lid member pivotable between first and second positions, each of said first and second parts of said segmented lid member including inner and outer side surfaces, respectively, said inner side surface of said first part of said segmented lid member fixedly attached to said outer side surface of said first wall to secure said first part of said segmented lid member to said body member;

wherein, in said first position, said second part of said segmented lid member limits access to said interior space by covering said aperture and, in said second position, said second part of said segmented lid member is positioned to permit access to said interior space, said second part of said segmented lid member engaging at least one of said walls of said body member in said second position, and wherein, in said second position, said outer side surface of said second part of said segmented lid member engages said outer side surface of said first wall.

6. The jewelry box of claim 5 and further comprising a sheath attached to said inner side surface of said second part of said segmented lid member.

7. A jewelry box, comprising:

a body member having walls which collectively define an aperture for accessing an interior space, said body member including first and second walls, each of said first and second walls of said body member having inner and outer side surfaces; and a segmented lid member having a first part secured to said body member and a second part hingedly coupled to said first part, said segmented lid member pivotable between first and second positions, said segmented lid member including a third part hingedly coupled to said second part, each of said first, second and third parts of said segmented lid member including inner and outer side surfaces, said inner side surface of said first part of said segmented lid member fixedly attached to said outer side surface of said first wall of said body member to secure said first part of said segmented lid member to said body member;

wherein, in said first position, said second part of said segmented lid member limits access to said interior space by covering said aperture and, in said second position, said second part of said segmented lid member is positioned to permit access to said interior space, said second part of said segmented lid member engaging at least one of said walls of said body member in said second position, and wherein, in said first position, said second and third parts of said segmented lid member limits access to said interior space by covering said aperture and, in said second position, said second and third parts of said segmented lid member are positioned to permit access to said interior space, said outer side surface of said second part of said segmented lid member engaging said outer side surface of said first part of said segmented lid member and said outer side surface of said third part of said segmented lid member engaging said outer side surface of said second wall of said body member in said second position.

8. The jewelry box of claim 7 and further comprising a sheath attached to said inner side surface of said second part of said segmented lid member.

9. A jewelry box, comprising:

a body member having walls which collectively define an aperture for accessing an interior space, said walls of said body member including first, second and third walls; and a segmented lid member having a first part secured to said body member, a second part hingedly coupled to said first part, a third part hingedly attached to said second part and a fourth part hingedly attached to said third part;

each of said first, second, third and fourth parts of said segmented lid member further comprising inner and outer side surfaces;

each of said first, second and third walls of said body member having inner and outer side surfaces;

said inner side surface of said first part of said segmented lid member fixedly attached to said outer side surface of said first wall of said body member to secure said first part of said segmented lid member to said body member;

said segmented lid member pivotable between first and second positions;

in said first position, said second and third parts of said segmented lid member limit access to said interior space by covering said aperture and said fourth part is received in said aperture to secure said segmented lid member in said first position; and in said second position, said second, third and fourth parts of said segmented lid member are positioned to permit access to said interior space, said outer side surface of said second part of said segmented lid member engaging said outer side surface of said first part of said segmented lid member, and said outer side surfaces of said third and fourth parts of said segmented lid member each engaging said outer side surface of said second wall in said second position.

10. The jewelry box of claim 9 and further comprising a sheath attached to said inner side surface of said second part of said segmented lid member.

11. A jewelry box, comprising:

a bottom wall having inner and outer side surfaces;

a front wall fixedly attached to said bottom wall, said front wall having inner side, outer side and upper edge surface;

a first side wall fixedly attached to said bottom and front walls, said first side wall having inner side, outer side and upper edge surfaces;

a rear wall fixedly attached to said bottom and first side walls, said rear wall having an inner side, outer side, and upper edge surfaces;

a second side wall fixedly attached to said bottom, rear and front walls, said second side wall having inner side, outer side and upper edge surfaces;

said bottom, front, first side, rear and second side walls collectively defining a tray structure having an interior area;

a segmented lid structure secured to said tray structure, said segmented lid structure having a first part, a second part hingedly coupled to said first part, a third part hingedly coupled to said second part and a fourth part hingedly coupled to said third part;

each one of said first, second, third and fourth parts of said segmented lid structure having inner and outer side surfaces; and said inner side surfaces of said first and second parts of said segmented lid structure fixedly attached to said outer side surfaces of said bottom and rear walls of said tray structure, respectively, to secure said segmented lid structure to said tray structure;

in said first position, said inner side surface of said third part of said segmented lid structure engaging said first side, rear and second side walls of said tray structure to cover a first portion of said interior area of said tray structure and said inner side surface of said fourth part of said segmented lid structure engaging said first and second side walls of said tray structure to cover a second portion of said interior area of said tray structure;

in said second position, said third and fourth parts of said segmented lid structure are positioned to permit access to said interior of said tray structure, said outer side surface of said third part of said segmented lid structure engaging said outer side surface of said second part of said segmented lid structure and said outer side surface of said fourth part of said segmented lid structure engaging said outer side surface of said first part of said segmented lid structure in said second position;

wherein said third part of said segmented lid structure can pivot approximately 270 degrees in a first direction along an axis of rotation relative to said second part of said segmented lid structure and said fourth part of said segmented lid structure can pivot approximately 180 degrees in said first direction along said axis of rotation relative to said third part of said segmented lid structure; and in pivoting from said first position to said second position, said third part of said segmented lid structure pivots, in said first direction, approximately 270 degrees relative to said second part of said segmented lid structure and said fourth part of said segmented lid structure pivots, in said first direction, approximately 90 degrees relative to said third part of said segmented lid structure.

12. A jewelry box, comprising:

a bottom wall having inner and outer side surfaces;

a front wall fixedly attached to said bottom wall, said front wall having inner side, outer side and upper edge surface;

a first side wall fixedly attached to said bottom and front walls, said first side wall having inner side, outer side and upper edge surfaces;

a rear wall fixedly attached to said bottom and first side walls, said rear wall having an inner side, outer side, and upper edge surfaces;

a second side wall fixedly attached to said bottom, rear and front walls, said second side wall having inner side, outer side and upper edge surfaces;

said bottom, front, first side, rear and second side walls collectively defining a tray structure having an interior area;

a segmented lid structure secured to said tray structure, said segmented lid structure having a first part, a second part hingedly coupled to said first part, a third part hingedly coupled to said second part and a fourth part hingedly coupled to said third part;

each one of said first, second, third and fourth parts of said segmented lid structure having inner and outer side surfaces; and said inner side surfaces of said first and second parts of said segmented lid structure fixedly attached to said outer side surfaces of said bottom and rear walls of said tray structure, respectively, to secure said segmented lid structure to said tray structure;

in said first position, said inner side surface of said third part of said segmented lid structure engaging said first side, rear and second side walls of said tray structure to cover a first portion of said interior area of said tray structure and said inner side surface of said fourth part of said segmented lid structure engaging said first and second side walls of said tray structure to cover a second portion of said interior area of said tray structure;

in said second position, said third and fourth parts of said segmented lid structure are positioned to permit access to said interior of said tray structure, said outer side surface of said third part of said segmented lid structure engaging said outer side surface of said second part of said segmented lid structure and said outer side surface of said fourth part of said segmented lid structure engaging said outer side surface of said first part of said segmented lid structure in said second position;

in said first position, said second part of said segmented lid structure is generally orthogonal to said first part of said segmented lid structure, said third part of said segmented lid structure is generally orthogonal to said second part of said segmented lid structure and generally parallel with said first part of said segmented lid structure and said fourth part of said segmented lid structure is generally planar to said third part of said segmented lid structure; and in said second position, said third part of said segmented lid structure is generally parallel to said second part of said segmented lid structure and said fourth part of said segmented lid structure is generally orthogonal to said third part of said segmented lid structure and generally parallel to said first part of said segmented lid structure.

13. The jewelry box of claim 12 and further comprising an insert for supportably holding an item of jewelry, said insert insertably received within said interior space of said tray structure and supportably mounted, within said interior space, by said inner side surface of said bottom wall.

14. The jewelry box of claim 13 wherein:

said segmented lid structure further comprises a fifth part hingedly attached to said fourth part;

in said first position, said fifth part of said segmented lid structure being generally orthogonal to said fourth part of said segmented lid structure; and in said second position, said fifth part of said segmented lid structure being generally planar with said fourth part of said segmented lid structure.

15. The jewelry box of claim 13 wherein:

said segmented lid structure further comprises a fifth part hingedly attached to said fourth part;

said fifth part of said segmented lid structure being capable of pivoting, in a first direction along an axis of rotation, approximately 270 degrees relative to said fourth part of said segmented lid structure and is capable of pivoting, in a second direction along said axis of rotation, approximately 90 degrees relative to said fourth part of said segmented lid structure.

16. The jewelry box of claim 13 wherein:

said segmented lid structure further comprises a fifth part hingedly attached to said fourth part;

in said first position, said fifth part of said segmented lid structure is generally orthogonal to said fourth part of said segmented lid structure and is insertably received in a slot between said insert and said inner side surface of said front wall to secure said segmented lid structure in said first position;

in said second position, said fifth part of said segmented lid structure is generally planar with said fourth part of said segmented lid structure; and in pivoting from said first position to said second position, said fifth part of said segmented lid structure pivoting 90 degrees relative to said fourth part of said segmented lid structure.

17. The jewelry box of claim 16 and further comprising a sheath attached to said inner side surface of said third part of said segmented lid structure.

18. The jewelry box of claim 17 and further comprising at least one character imprinted on said inner side surface of said fifth part of said segmented lid structure.

19. The jewelry box of claim 18 and further comprising at least one character imprinted on said outer side surface of said fourth part of said segmented lid structure.

* * * * *